US008647001B2

(12) United States Patent
Murata et al.

(10) Patent No.: US 8,647,001 B2
(45) Date of Patent: Feb. 11, 2014

(54) RECORDING APPARATUS INCLUDING MEDIUM ATTRACTING UNIT

(75) Inventors: Satoshi Murata, Okazaki (JP); Hisashi Igi, Nagoya (JP); Kenichi Sato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 352 days.

(21) Appl. No.: 12/981,100

(22) Filed: Dec. 29, 2010

(65) Prior Publication Data

US 2011/0158730 A1 Jun. 30, 2011

(30) Foreign Application Priority Data

Dec. 29, 2009 (JP) ..... 2009-299034

(51) Int. Cl.
*B41J 13/08* (2006.01)

(52) U.S. Cl.
USPC ..... 400/578; 399/361; 347/104; 271/275

(58) Field of Classification Search
USPC ..... 400/578
See application file for complete search history.

(56) References Cited

U.S. PATENT DOCUMENTS

| | | | | |
|---|---|---|---|---|
| 4,978,118 | A * | 12/1990 | Kasahara | 271/275 |
| 5,121,170 | A * | 6/1992 | Bannai et al. | 399/303 |
| 5,176,374 | A * | 1/1993 | Yamada | 271/275 |
| 5,187,536 | A * | 2/1993 | Hasegawa et al. | 399/300 |
| 6,108,510 | A * | 8/2000 | Nakane | 399/303 |
| 6,695,504 | B2 * | 2/2004 | Matsumoto | 400/635 |
| 6,789,888 | B2 * | 9/2004 | Kiyama | 347/104 |
| 7,837,320 | B2 * | 11/2010 | Mohri et al. | 347/104 |
| 2004/0041897 | A1 * | 3/2004 | Chino et al. | 347/153 |
| 2005/0270355 | A1 * | 12/2005 | Sootome et al. | 347/104 |
| 2006/0050124 | A1 * | 3/2006 | Adachi | 347/104 |
| 2006/0279621 | A1 * | 12/2006 | Morohoshi | 347/104 |
| 2007/0109386 | A1 | 5/2007 | Mohri et al. | |

FOREIGN PATENT DOCUMENTS

| | | | |
|---|---|---|---|
| JP | H10-338376 | A | 12/1998 |
| JP | 2000-246982 | A | 9/2000 |
| JP | 2005-242260 | A | 9/2005 |
| JP | 2007-130975 | A | 5/2007 |
| JP | 2007-230035 | A | 9/2007 |

OTHER PUBLICATIONS

Japan Patent Office, Notice of Reasons for Rejection for Japanese Patent Application No. 2009-299034, mailed Nov. 15, 2011.

* cited by examiner

*Primary Examiner* — Jill Culler
(74) *Attorney, Agent, or Firm* — Baker Botts L.L.P.

(57) ABSTRACT

A recording apparatus includes: a record head which forms an image on a recording medium; a conveyance mechanism which has an outer circumferential surface opposing the record head and conveys the recording medium placed on the outer circumferential surface; and a media attracting unit which causes the recording medium to be attracted onto the outer circumferential surface and includes a first electrode which is provided to oppose an inner circumferential surface of the conveyance belt which surface is opposite to the outer circumferential surface of the conveyance belt, a second electrode which opposes the outer circumferential surface of the conveyance belt and is detached from the outer circumferential surface, and a voltage supply unit which applies a voltage across the first electrode and the second electrode.

2 Claims, 5 Drawing Sheets

RECORDING APPARATUS INCLUDING MEDIUM ATTRACTING UNIT

CROSS REFERENCE TO RELATED APPLICATION

The present application claims priority from Japanese Patent Application No. 2009-299034, which was filed on Dec. 29, 2009 the disclosure of which is herein incorporated by reference in its entirety.

BACKGROUND OF THE INVENTION

As an example of conventional recording apparatuses, there is an inkjet printer which includes a conveyance belt stretched between a drive roller and a driven roller, a charging roller which is provided to oppose the driven roller and pushes a sheet onto the conveyance belt, and a power source which applies a DC voltage to the charging roller. In this inkjet printer, the charging roller is driven while sandwiching the conveyance belt and the sheet with the grounded driven roller. As a DC voltage is applied from the power source to the charging roller, a predetermined electric potential difference is generated between the charging roller and the driven roller. As the sheet is charged in this way, the sheet is attracted onto the conveyance belt.

SUMMARY OF THE INVENTION

In the conventional art above, the charging roller is in contact with the outer circumferential surface of the conveyance belt when it does not sandwich a sheet with the conveyance belt. Because of this structure, when ink adheres to the outer circumferential surface of the conveyance belt, this ink may be transferred to the charging roller before the cleaning of the ink by a cleaning apparatus is completed. As a result, the ink adhering to the charging roller is further transferred onto the sheet and the sheet is stained.

In consideration of the above, an objective of the present invention is to provide a recording apparatus which restrain recording media from being stained.

To achieve the objective above, a recording apparatus of the present invention includes: a record head which forms an image on a recording medium; a conveyance mechanism which has an outer circumferential surface opposing the record head and conveys the recording medium placed on the outer circumferential surface; and a media attracting unit which causes the recording medium to be attracted onto the outer circumferential surface and includes a first electrode which is provided to oppose an inner circumferential surface of the conveyance belt which surface is opposite to the outer circumferential surface of the conveyance belt, a second electrode which opposes the outer circumferential surface of the conveyance belt and is detached from the outer circumferential surface, and a voltage supply unit which applies a voltage across the first electrode and the second electrode.

In another aspect, a recording apparatus of the present invention includes: a record head which forms an image on a recording medium; a conveyance mechanism which has an outer circumferential surface opposing the record head and conveys the recording medium placed on the outer circumferential surface; and a media attracting unit which causes the recording medium to be attracted onto the outer circumferential surface and includes a first electrode and a second electrode which are provided to oppose an inner circumferential surface of the conveyance belt which surface is opposite to the outer circumferential surface of the conveyance belt and a voltage supply unit which applies a voltage across the first electrode and the second electrode.

DESCRIPTION OF THE PREFERRED EMBODIMENTS

The following will describe preferred embodiments of the present invention with reference to figures.

First Embodiment

Figure 1:
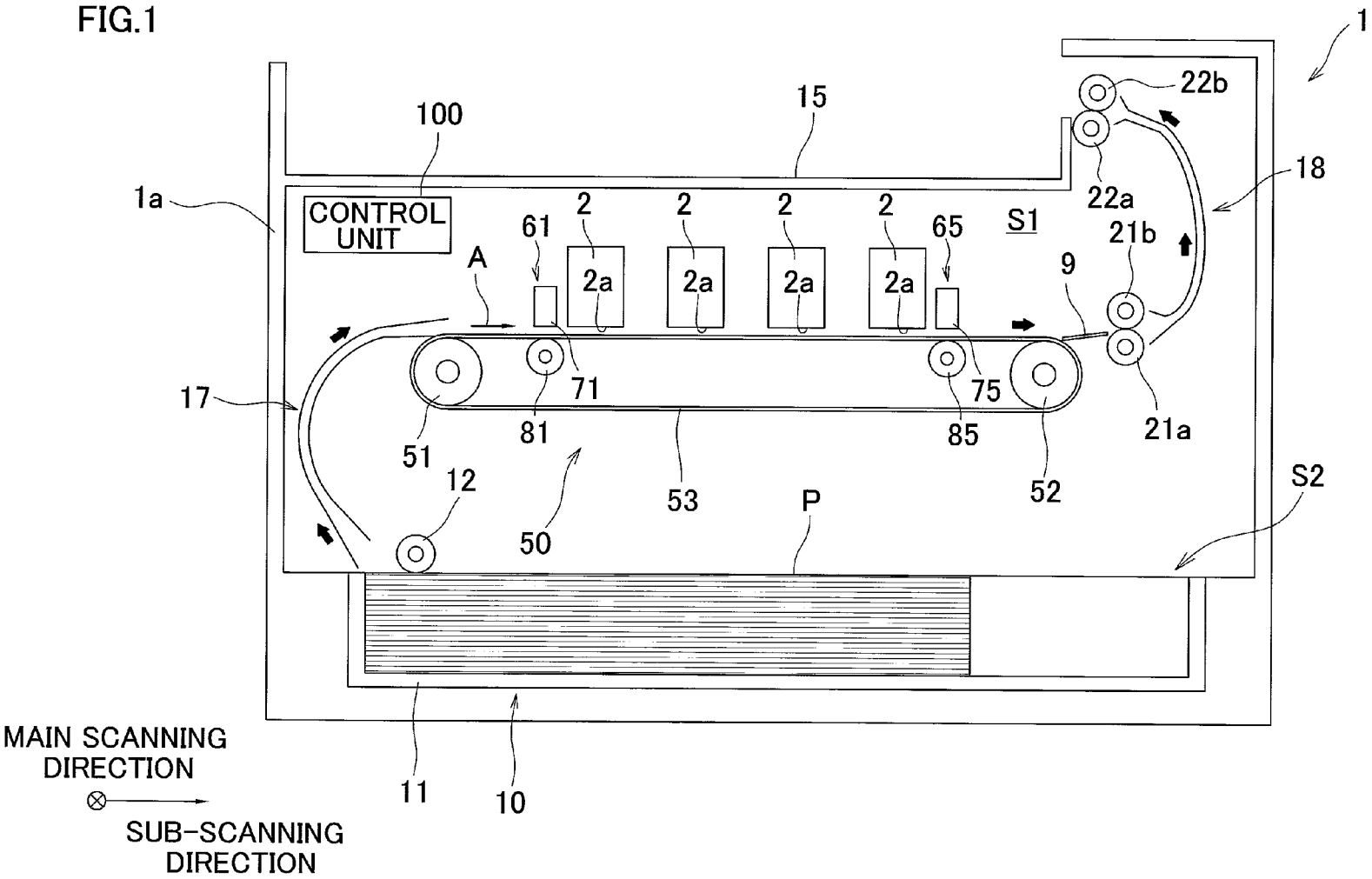
FIG. 1 is a schematic profile of the internal structure of an inkjet printer of according to First Embodiment of the present invention.

An inkjet printer 1 according to First Embodiment of the present invention includes a rectangular parallelepiped chassis 1*a* and a sheet discharge unit 15 is formed at its upper part, as shown in FIG. 1. The space inside the chassis 1*a* is divided into an upper space S1 and a lower space S2. In the space S1 are provided four inkjet heads 2 ejecting magenta, cyan, yellow, and black inks and a conveyance mechanism 50 which is below the inkjet heads 2 and conveys sheets P in the conveyance direction A. The space S2 houses a sheet feed unit 10. The inkjet printer 1 further includes a control unit 100 which controls the operations of the components above. It is noted that the present embodiment assumes that the direction in parallel to the conveyance direction A of sheets P by the conveyance mechanism 50 is a sub-scanning direction and the direction which is orthogonal to the sub-scanning direction and in parallel to the horizontal plane is a main scanning direction.

Each of the four inkjet heads 2 has, as shown in FIG. 1, a substantially rectangular parallelepiped shape which is long in the main scanning direction. This indicates that the inkjet printer 1 is a line printer. Each inkjet head 2 is a laminated body in which a passage unit in which ink passages having pressure chambers are formed is laminated with actuators which apply pressures to the ink in the pressure chambers. The bottom surface of the inkjet head 2 functions as an ejection surface 2*a* for ejecting ink. The ejection surface 2*a* has a plurality of ejection openings through which ink is discharged.

Inside the inkjet printer 1 is formed a sheet conveyance path on which sheets P are conveyed from the sheet feed unit 10 to the sheet discharge unit 15 along the thick arrows shown in FIG. 1. The sheet feed unit 10 includes a sheet feed cassette 11 capable of storing stacked plurality of sheets P, a sheet feeding roller 12 which sends out sheets P from the sheet feed cassette 11, and a sheet feeding motor which rotates the sheet feeding roller 12 under the control of the control unit 100.

The sheet feeding roller 12 sends out the topmost sheet P of the plurality of sheets P stacked in the sheet feed cassette 11. To the left of the conveyance mechanism 50 in FIG. 1, a conveyance guide 17 is provided to curve upward from the sheet feed cassette 11.

With this structure, as the sheet feeding roller 12 rotates clockwise in FIG. 1 under the control of the control unit 100, a sheet P contacting the sheet feeding roller 12 is conveyed to the conveyance mechanism 50 via the conveyance guide 17.

The conveyance mechanism 50 is, as shown in FIG. 1, provided to oppose the four inkjet heads 2, and has two belt rollers 51 and 52, an endless conveyance belt 53 stretched between the rollers 51 and 52, and a conveyance motor which rotates the belt roller 52 under the control of the control unit 100. The two belt rollers 51 and 52 are aligned along the conveyance direction A.

The conveyance belt 53 is made of polyimide and fluororesin, for example. This belt 53 has a volume resistivity of about $10^8$ to $10^{14}$ Ωcm and is flexible. As long as the volume resistivity above and flexibility are achieved, the conveyance belt 53 may be made of any kinds of materials.

Figure 2A:
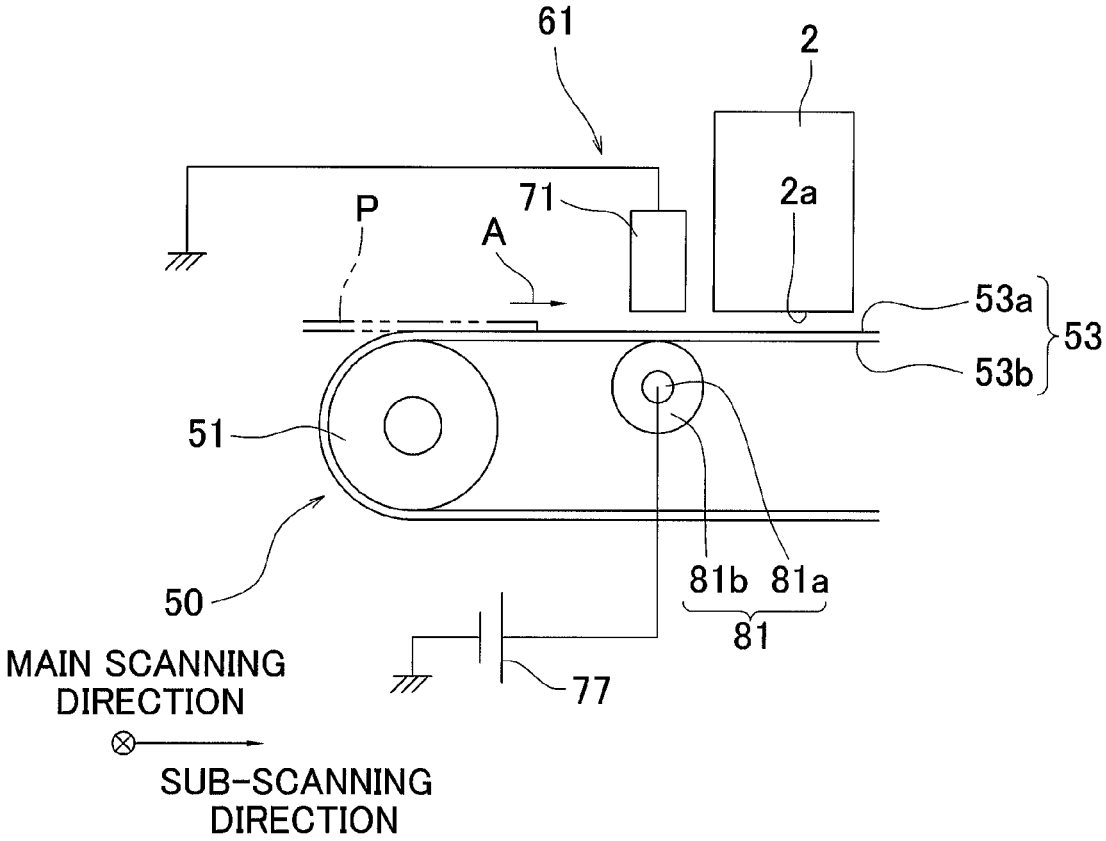
FIG. 2A is a partial enlarged view of the inkjet printer of FIG. 1.

As shown in FIG. 1 and FIG. 2A, in the vicinity of the upper part of the conveyance belt 53, two attracting mechanisms 61 and 65 are aligned in the conveyance direction A. The attracting mechanism 61 includes a grounding component 71 (second electrode) and a charging roller 81 (first electrode) by which the upper part of the conveyance belt 53 is sandwiched. In a similar manner, the attracting mechanism 65 includes a grounding component 75 (second electrode) and a charging roller 85 (first electrode) by which the upper part of the conveyance belt 53 is sandwiched. The attracting mechanism 61 is provided upstream of the most upstream inkjet head 2 in the conveyance direction A. The attracting mechanism 65 is provided downstream of the most downstream inkjet head 2 in the conveyance direction A.

The grounding components 71 and 75 of the attracting mechanisms 61 and 65 are grounded. On the other hand, the charging rollers 81 and 85 are connected to the positive electrode of a DC power source (supply unit) 77. The negative electrode of the DC power source 77 is grounded. The DC power source 77 applies, under the control of the control unit 100, a predetermined electric potential (e.g. +3 kV) to the charging rollers 81 and 85. Each of the attracting mechanisms 61 and 65 and the DC power source 77 constitute a media attracting unit which attracts a sheet P onto the outer circumferential surface 53*a* of the conveyance belt 53. It is noted that the attracting mechanisms 61 are 65 different from each other only in their positions. For this reason, the following will only describe the attracting mechanism 61, and the other attracting mechanism 65 will not be detailed.

The grounding component 71 of the attracting mechanism 61 has a rectangular parallelepiped shape which is long along the main scanning direction, and is distanced from the outer circumferential surface 53*a* of the conveyance belt 53. Moreover, the grounding component 71 is supported by the chassis 1*a*. The distance between the grounding component 71 and the outer circumferential surface 53*a* of the conveyance belt 53 is arranged to allow the electrostatic discharge between the grounding component 71 and a sheet P conveyed to the gap between the grounding component 71 and the outer circumferential surface 53*a*. It is noted that the electrostatic discharge may also occur between the grounding component 71 and the conveyance belt 53 when no sheet P is placed on the outer circumferential surface 53*a*. The grounding component 71 is substantially as long as the conveyance belt 53 in the main scanning direction.

The charging roller 81 is column-shaped and its axis extends in the main scanning direction, and is substantially as long as the grounding component 71 in the main scanning direction. The charging roller 81 is constituted by a metal rotation shaft 81*a* and a roller main body 81*b* fixed to the outer circumference of the rotation shaft 81*a*. The roller main body 81*b* is made of a conductive or semi-conductive elastic material. The rotation shaft 81*a* is rotatably supported by a supporting member which also supports the belt rollers 51 and 52. The outer circumferential surface of the roller main body 81*b* contacts the inner circumferential surface 53*b* of the conveyance belt 53. The rotation shaft 81*a* is connected to the positive electrode of the DC power source 77.

The distance between the outer circumferential surface of the charging roller 81 and the inner circumferential surface 53*b* increases as the charging roller 81 and the conveyance belt 53 are distanced from their contact position in the conveyance direction A. When the outer circumferential surface of the charging roller 81 is away from the inner circumferential surface 53*b* for a predetermined distance, the electrostatic discharge from the charging roller 81 to the conveyance belt 53 becomes possible. In this regard, when a predetermined electric potential is applied to the charging roller 81, the charging roller 81 supplies an electric current to the conveyance belt 53, at a position where the outer circumferential surface of the charging roller 81 and the inner circumferential surface 53*b* are distanced from each other for the above-described predetermined distance. As such, since the electrode supplying an electric current to the conveyance belt 53 is the roller-shaped charging roller 81, it is unnecessary to adjust the electrostatic discharge gap with the conveyance belt 53. In other words, the adjustment of the discharge gap is achieved only by causing the charging roller 81 to contact the inner circumferential surface 53*b*.

As described above, the attracting mechanisms 61 and 65 are arranged so that the charging rollers 81 and 85 are positioned to allow electrostatic discharge to the conveyance belt 53. Furthermore, the grounding components 71 and 75 are positioned to allow electrostatic discharge to a conveyed sheet P. In other words, discharge circuits including the conveyance belt 53 and the sheet P placed on the outer circumferential surface 53*a* of the conveyance belt 53 are formed between the charging roller 81 and the grounding component 71 and between the charging rollers 85 and 75, respectively.

With this structure, the conveyance belt 53 moves in the conveyance direction A as the belt roller 52 rotates clockwise in FIG. 1 under the control of the control unit 100. By the movement of the conveyance belt 53, the belt roller 51 and the charging rollers 81 and 85 also rotate clockwise in FIG. 1. At the same time, the DC power source 77 applies positive electric potentials to the charging rollers 81 and 85 under the control of the control unit 100, with the result that predetermined voltages are generated between the charging rollers 81 and 85 and the grounding components 71 and 75 which are at the ground potential.

Figure 2B:
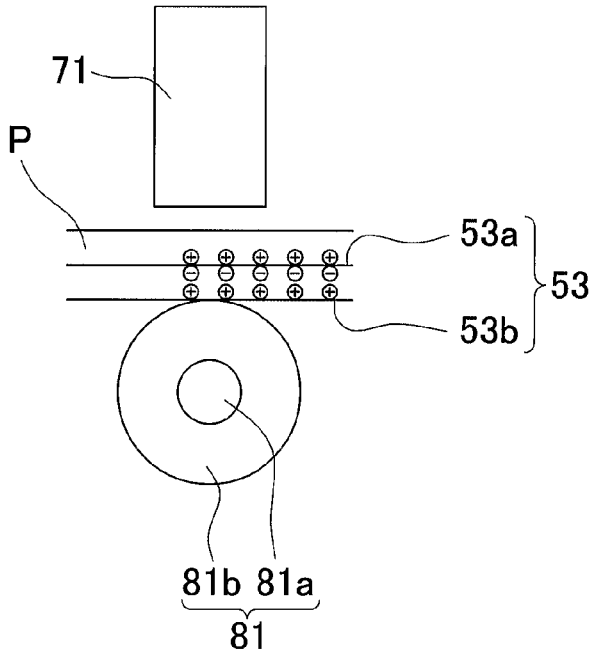
FIG. 2B shows a case where a voltage is supplied across a grounding component and a charging roller in First Embodiment.

When the predetermined voltages are generated between the charging roller 81 and the grounding component 71 and between the charging roller 85 and the grounding component 75, electrostatic discharge occurs between the sheet P and the grounding component 71 and between the sheet P and the grounding component 75, with the result that the sheet P is grounded. Thereafter, as shown in FIG. 2B, electrostatic discharge occurs from the charging rollers 81 and 85 to the conveyance belt 53, so that the inner circumferential surface 53*b* of the conveyance belt 53 is positively charged. In response, the outer circumferential surface 53*a* of the conveyance belt 53 is negatively charged on account of the charge polarization of the conveyance belt 53, whereas the surface of the sheet P which surface opposes the outer circumferential surface 53*a* is positively charged on account of the charge polarization of the sheet P. As a result, the sheet P is electrostatically attracted onto the outer circumferential surface 53*a* of the conveyance belt 53. As such, the sheet P is attracted onto the conveyance belt 53 as the sheet P and the conveyance belt 53 are charged by the attracting mechanisms 61 and 65. The regions in the sheet P or the conveyance belt 53 which regions are once charged are kept charged for a while. For this reason, the attracting force is maintained to some degree at positions which are downstream of the attracting mechanisms 61 and 65 in the conveyance direction.

Figure 3:
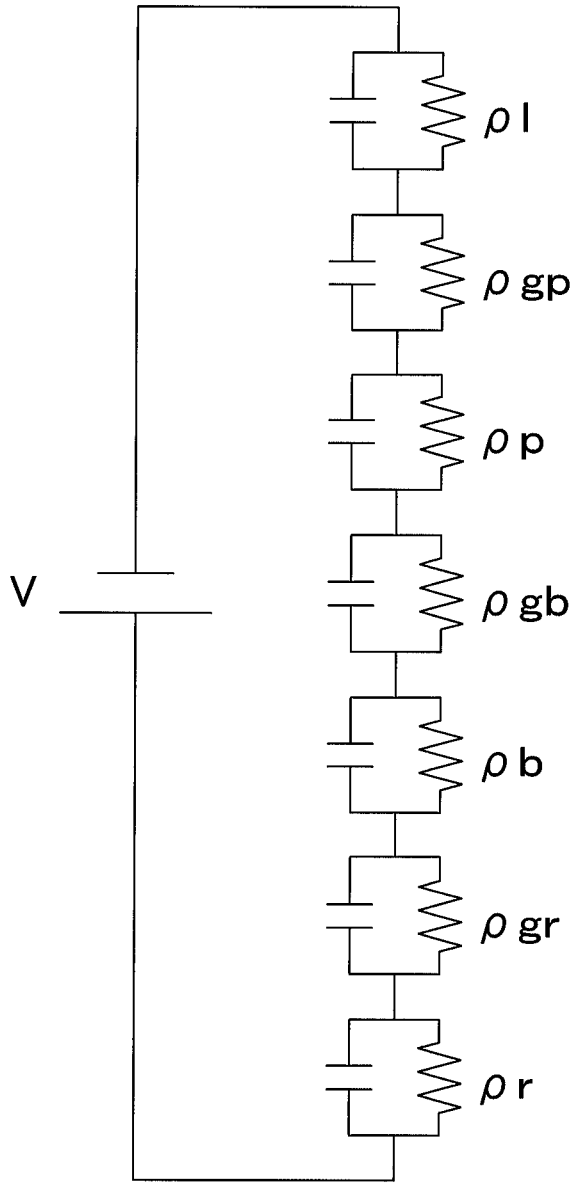
FIG. 3 is a diagram of an electric circuit formed in the attracting mechanism of FIG. 1.

FIG. 3 shows an electric circuit (discharge circuit) which is formed when a voltage V is supplied across the charging roller 81 and the grounding component 71. It is noted that the electric circuit shown in FIG. 3 is merely a model representing the present embodiment as an optimal electrical configuration.

The path of this electric circuit is arranged as follows: the charging roller 81→the conveyance belt 53→the sheet P→the grounding component 71. The symbols such as ρr in FIG. 3 indicate the electric resistances of the respective parts along the path. More specifically, the symbols ρr, ρgr, ρb, ρgb, ρp, ρgp, and ρl indicate the electric resistance of the charging roller 81, the contact resistance between the charging roller 81 and the conveyance belt 53, the electric resistance of the conveyance belt 53, the contact resistance between the conveyance belt 53 and the sheet P, the electric resistance of the sheet P, the contact resistance between the sheet P and the grounding component 71, and the electric resistance of the grounding component 71, respectively.

In addition to the above, this electric circuit has, as shown in FIG. 3, capacitors connected in parallel to the respective electric resistances. The opposing surfaces of the sheet P and the conveyance belt 53 have small irregularities. When the voltage V is supplied across the charging roller 81 and the grounding component 71, a minute current flows across a microscopic gap between the sheet P and the conveyance belt 53 at a portion of the irregularities in which portion the sheet P contacts the conveyance belt 53, and an electric potential difference occurs at the gap. On the other hand, electric potentials having different polarities are accumulated at a portion of the irregularities in which portion the sheet P does not contact the conveyance belt 53. Because of the electric potentials of different polarities, an attracting force based on a Coulomb force is generated between the sheet P and the conveyance belt 53. This attracting force is termed a Johnsen-Rahbek force. Also because of this force, the sheet P on the conveyance belt 53 is electrostatically attracted onto the outer circumferential surface 53*a*. Since the attracting force due to the Johnsen-Rahbek force is generated when a current flows across the sheet P and the conveyance belt 53, this force is generated only in portions where the attracting mechanisms 61 and 65 are provided.

In this way, the sheet P sent out from the sheet feed unit 10 is conveyed in the conveyance direction A while being attracted onto the outer circumferential surface 53*a*. As the conveyed sheet P serially passes through the portions immediately below the four inkjet heads 2 (i.e. the portions opposing the ejection surface 2*a*), the control unit 100 controls the inkjet heads 2 so that inks of the respective colors are ejected onto the sheet P. As a result, a desired color image is formed on the sheet P. In this connection, the attracting force generated when the attracting mechanism 61 charges the sheet P or the conveyance belt 53 is retained to some degree at a portion which is downstream of the attracting mechanism 61 and opposes the inkjet head 2. Therefore, the attracting force generated by the attracting mechanism 61 allows the inkjet head 2 to conduct printing on the sheet P while the sheet P is attracted onto the conveyance belt 53. Furthermore, the attracting mechanism 65 provided downstream of the inkjet head 2 causes the downstream part of the sheet P to be attracted onto the conveyance belt 53 by the Johnsen-Rahbek force. This prevents the downstream part of the sheet P from being detached from the conveyance belt 53 and causes the sheet P to be attracted onto the outer circumferential surface 53*a* until the tail end of the sheet P passes through the most downstream inkjet head 2. Furthermore, since the attracting mechanism 65 causes the sheet P to be attracted onto the conveyance belt 53 even after the tail end of the sheet P passes through the most downstream inkjet head 2, it is possible to prevent the tail edge (i.e. the most upstream part) of the sheet P on which a color image has been formed from being detached from the conveyance belt 53.

Immediately downstream of the conveyance mechanism 50 in the conveyance direction A is provided a peeling unit 9. This peeling unit 9 peels the sheet P off from the outer circumferential surface 53*a* by inserting the tip into the gap between the sheet P and the conveyance belt 53.

Between the conveyance mechanism 50 and the sheet discharge unit 15, four forwarding rollers 21*a*, 21*b*, 22*a*, and 22*b* and a conveyance guide 18 between the forwarding rollers 21*a* and 21*b* and 22*a* and 22*b* are provided along the conveying path. The forwarding rollers 21*a* and 22*b* are rotated by a feed motor which is under the control of the control unit 100.

With this structure, under the control of the control unit 100, the forwarding rollers 21*a* and 22*b* are rotated, and the sheet P discharged from the conveyance mechanism 50 is sent to the upper part of FIG. 1 via the conveyance guide 18, while being pinched by the forwarding rollers 21*a* and 21*b*. The sheet P is then sent to the sheet discharge unit 15 while being pinched by the forwarding rollers 22*a* and 22*b*. The forwarding rollers 21*b* and 22*a* are driven rollers which are driven in line with the conveyance of sheets.

As described above, the inkjet printer 1 of the present embodiment is advantageous in that, since the grounding components 71 and 75 and the charging rollers 81 and 85 for attracting a sheet P onto the outer circumferential surface 53*a* are all detached from the outer circumferential surface 53*a*, ink adhering the outer circumferential surface 53*a* of the conveyance belt 53 is transferred to none of the grounding components 71 and 75 and the charging rollers 81 and 85. For this reason, the sheet P is not stained by the attracting mechanisms 61 and 65.

In addition to the above, since the grounding components 71 and 75 are provided to oppose the charging rollers 81 and 85 with the conveyance belt 53 being interposed therebetween, it is possible to effectively attract the sheet P onto the outer circumferential surface 53*a* by electrostatic discharge between the grounding components 71 and 75 and the sheet P and between the charging rollers 81 and 85 and the conveyance belt 53. As a variation, an electrode (first electrode) contacting the inner circumferential surface 53*b* of the conveyance belt 53 may be provided in place of the charging roller 81 or 85. It is possible also in this case to effectively attract the sheet P onto the outer circumferential surface 53*a* by electrostatic discharge between the sheet P and the grounding component 71 or 75.

Second Embodiment

Figure 4A:
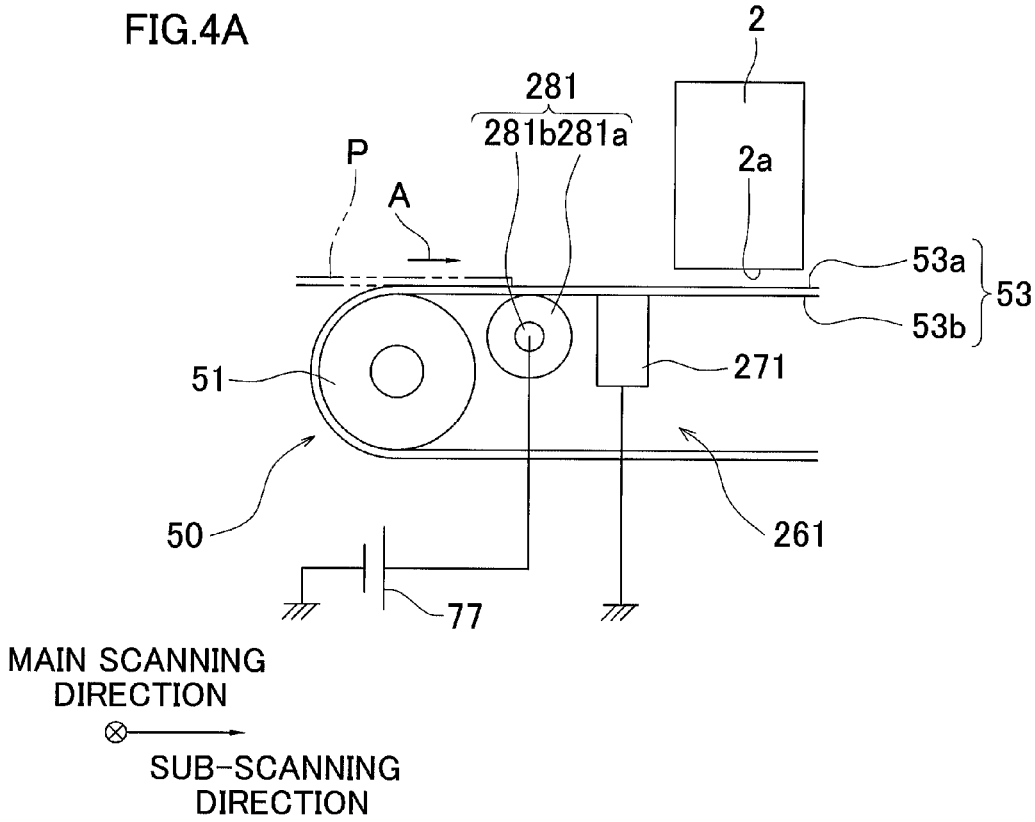
FIG. 4A is a partial enlarged view of an inkjet printer according to Second Embodiment of the present invention.

Now, an inkjet printer according to Second Embodiment of the present invention will be described with reference to FIGS. 4A, 4B, and 5.

The inkjet printer of the present embodiment is identical with the inkjet printer of First Embodiment except that the attracting mechanism 65 of First Embodiment is not provided and an attracting mechanism 261 is provided in place of the attracting mechanism 61. In this embodiment, the same components as in First Embodiment are denoted by the same reference numerals as in First Embodiment, respectively, and the description thereof will be omitted.

The attracting mechanism 261 is provided upstream of the inkjet heads 2 in the conveyance direction A and includes a charging roller (first electrode) 281 and a grounding component (second electrode) 271 connected to the ground. The charging roller 281 and the grounding component 271 are provided in the region circumscribed by the conveyance belt 53, and are disposed in this order in the conveyance direction A. The charging roller 281 and the grounding component 271 contact the inner circumferential surface 53*b* at the upper part of the conveyance belt 53. In other words, the charging roller 281 and the grounding component 271 are detached from the outer circumferential surface 53*a*. In addition to the above, the charging roller 281 is connected to the positive electrode of the DC power source 77, and hence the attracting mechanism 261 and the DC power source 77 constitute a media attracting unit by which a sheet P is attracted onto the outer circumferential surface 53*a* of the conveyance belt 53.

The charging roller 281 has, similar to the charging roller 81 of First Embodiment, a column shape having a shaft in parallel to the main scanning direction, and is substantially as long as the grounding component 271 in the main scanning direction. Also, the charging roller 281 includes a metal rotation shaft 281*a* and a roller main body 281*b* fixed to the outer circumference of the rotation shaft 281*a*. The roller main body 281*b* is made of a conductive or semi-conductive elastic member. The rotation shaft 281*a* is rotatably supported by the supporting member which also supports the belt rollers 51 and 52, and the outer circumferential surface of the roller main body 281*b* contacts the inner circumferential surface 53*b* of the conveyance belt 53. Being similar to the charging roller 81 of First Embodiment, the electrostatic discharge from the charging roller 281 to the conveyance belt 53 is possible.

The grounding component 271 has a rectangular parallelepiped shape which is long in the main scanning direction, as in the case of the grounding component 71 of First Embodiment. The grounding component 271 is supported by the supporting member which also supports the belt rollers 51 and 52, and the horizontal upper surface of the component 271 contacts the inner circumferential surface 53*b*. That is to say, the grounding component 271 of the present embodiment is not provided at a position where the electrostatic discharge to the conveyance belt 53 is possible. The grounding component 271 is substantially as long as the conveyance belt 53 in the main scanning direction.

As such, the charging roller 281 and the grounding component 271 are positioned so that the electrostatic discharge occurs only between the charging roller 281 and the conveyance belt 53. Across the grounding component 271 and the conveyance belt 53, an electric current directly flows via the contact point therebetween. In other words, between the charging roller 281 and the grounding component 271, an electrostatic discharge circuit including the conveyance belt 53 and the sheet P placed on the outer circumferential surface 53*a* of the conveyance belt 53 may be formed.

According to this arrangement, the belt roller 52 is rotated clockwise in FIG. 1 under the control of the control unit 100 so that the conveyance belt 53 moves in the conveyance direction A, and this movement of the conveyance belt 53 causes the belt roller 51 and the charging roller 281 to rotate clockwise in FIG. 4. In so doing, under the control of the control unit 100, a positive electric potential (+3 kV) is applied from the DC power source 77 to the charging roller 281. Between the grounding component 271 kept at the ground potential and the charging roller 281, a predetermined voltage is generated.

Figure 4B:
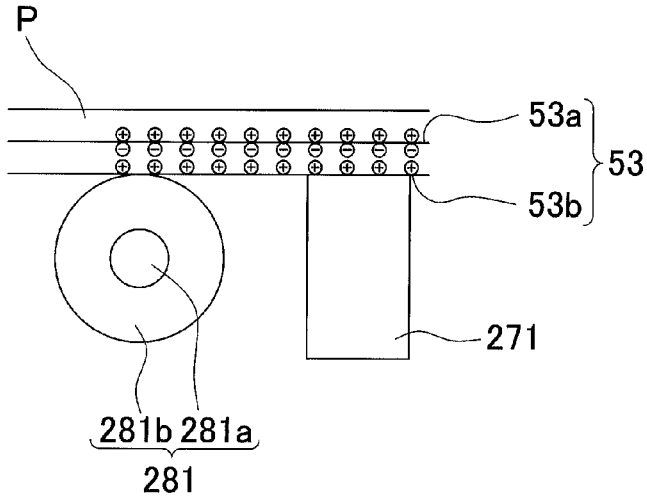
FIG. 4B shows a case where a voltage is supplied across a grounding component and a charging roller in Second Embodiment.

When the predetermined voltage is supplied across the charging roller 281 and the grounding component 271, as shown in FIG. 4B, the electrostatic discharge from the charging roller 281 to the conveyance belt 53 occurs and hence the inner circumferential surface 53*b* of the conveyance belt 53 is positively charged. At the same time, the outer circumferential surface 53*a* of the conveyance belt 53 is negatively charged by charge polarization of the conveyance belt 53. Also, if the conveyance belt 53 is moving in the conveyance direction A in this case, the outer circumferential surface 53*a* of the upper part of the conveyance belt 53 is negatively charged at a portion downstream of the portion opposing the charging roller 281. When the sheet P is conveyed to the portion of the conveyance belt 53 which portion opposes the charging roller 281, the sheet P is positively charged at the surface opposing the outer circumferential surface 53*a*, on account of charge polarization. As a result, the sheet P is electrostatically attracted onto the outer circumferential surface 53*a*.

Figure 5:
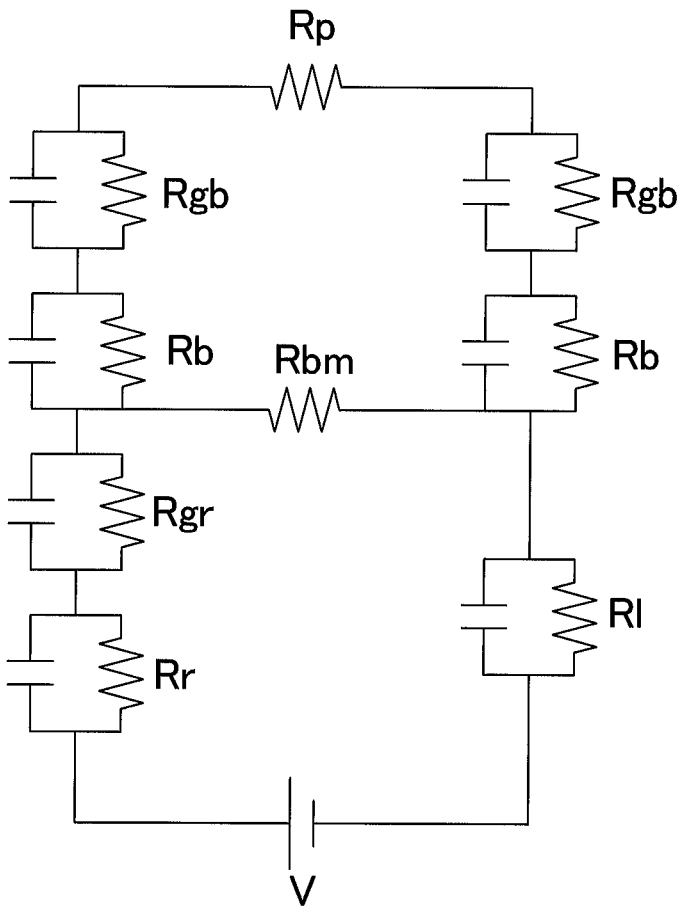
FIG. 5 is a diagram of an electric circuit formed in the attracting mechanism of FIG. 4.

FIG. 5 shows an electric circuit (discharge circuit) which is formed when a voltage V is supplied across the charging roller 281 and the grounding component 271. It is noted that the electric circuit shown in FIG. 5 is merely a model representing the present embodiment as an optimal electrical configuration.

The path of this electric circuit is arranged as follows: the charging roller 281→the conveyance belt 53→the sheet P→the conveyance belt 53→the grounding component 271. The symbols such as Rr in FIG. 5 indicate the electric resistances of the respective parts along the path. More specifically, the symbols Rr, Rgr, Rb, Rgb, Rp, and Rl indicate the electric resistance of the charging roller 281, the contact resistance between the charging roller 281 and the conveyance belt 53, the electric resistance of the conveyance belt 53, the contact resistance between the conveyance belt 53 and the sheet P, the electric resistance of the sheet P, and the electric resistance of the grounding component 271, respectively.

In addition to the above, the electric circuit includes a bypass connected in parallel to the path above, and indicated by Rbm is the electric resistance of the bypass. More specifically, indicated by Rbm is the electric resistance of the bypass which connects the charging roller 281 side with the grounding component 271 side via the conveyance belt 53 without passing through the sheet P.

In this way, the sheet P sent out from the sheet feed unit 10 is conveyed in the conveyance direction A while being attracted onto the outer circumferential surface 53*a* and each inkjet head 2 ejects ink onto the sheet P, with the result that a desired color image is formed on the sheet P.

As described above, also in the inkjet printer of the present embodiment, both of the grounding component 271 and the charging roller 281 for attracting the sheet P onto the outer circumferential surface 53*a* oppose the inner circumferential surface 53*b*, and hence the ink adhering to the outer circumferential surface 53*a* of the conveyance belt 53 is not transferred to the grounding component 271 and the charging roller 281. Therefore the sheet P is not stained by the attracting mechanism 261.

In First Embodiment, there are two attracting mechanisms 61 and 65. Alternatively, only one of these attracting mechanisms is provided, preferably the attracting mechanism 61 is provided. This arrangement allows a sheet P to pass through the portion opposing the most upstream inkjet head 2 while the sheet P is being attracted onto the conveyance belt 53.

Also in Second Embodiment above, it is possible to provide an attracting mechanism on the downstream of the most downstream inkjet head 2. In addition, in First and Second Embodiments, an attracting mechanism may also be provided between the inkjet heads 2.

The preferred embodiments of the present invention have been described above. The present invention, however, is not limited to them and may be variously changed within the scope of claims. For example, in Second Embodiment the grounding component 271 may be replaced with a charging roller. In this case, the movement load of the conveyance belt 53 may be restrained because the charging roller rotates in accordance with the movement.

In First and Second Embodiments, a grounding component detached from the inner circumferential surface 53*b* may be provided in place of the charging roller 81, 85, or 281. Furthermore, Second Embodiment may be arranged so that the grounding component 271 is detached from the inner circumferential surface 53*b*. In this case, the grounding component 271 is preferably arranged so that the electrostatic discharge from the grounding component 271 to the conveyance belt 53 is possible. It is also noted that the present invention may be used for a recording apparatus which has a record head other than the inkjet head.

What is claimed is:

1. A recording apparatus comprising:

one or more record heads which form an image on a recording medium;

a conveyance mechanism comprising a conveyance belt, having an outer circumferential surface opposing the one or more record heads, and conveyance rollers between which the conveyance belt is stretched, the conveyance mechanism conveying the recording medium placed on the outer circumferential surface by rotating at least one of the conveyance rollers;

a first media attracting unit, which causes the recording medium to be attracted onto the outer circumferential surface and is downstream from all of the one or more record heads in a conveyance direction in which the recording medium is conveyed, comprising:

a first electrode, which is provided to oppose an inner circumferential surface of the conveyance belt which surface is opposite to the outer circumferential surface of the conveyance belt, a second electrode, which opposes the outer circumferential surface of the conveyance belt and is detached from the outer circumferential surface, and a voltage supply unit which applies a voltage across the first electrode and the second electrode;

a second media attracting unit, which causes the recording medium to be attracted onto the outer circumferential surface and is upstream from the one or more record heads in a conveyance direction in which the recording medium is conveyed, comprising:

a third electrode, which is provided to oppose an inner circumferential surface of the conveyance belt which surface is opposite to the outer circumferential surface of the conveyance belt, a fourth electrode, which opposes the outer circumferential surface of the conveyance belt and is detached from the outer circumferential surface, and a second voltage supply unit which applies a voltage across the third electrode and the fourth electrode; and a roller pair, downstream of the conveyance belt in the conveyance direction, to convey the recording medium, wherein:

the first electrode comprises a charging roller, which is different from the conveyance rollers, the second electrode opposes the first electrode over the conveyance belt and opposes the recording medium on the outer circumferential surface with a gap therebetween, and the roller pair is configured at a position such that the downstream end of the recording medium engages the roller pair while the recording medium opposes the recording head.

2. The recording apparatus according to claim 1, wherein, the first electrode and the second electrode are positioned so that, when a voltage is supplied by the voltage supply unit, a discharge circuit including the conveyance belt and the recording medium placed on the outer circumferential surface is formed and electrostatic discharge is possible between at least one of the first electrode and the second electrode and one of the conveyance belt and the recording medium placed on the outer circumferential surface.

* * * * *